US005086749A

United States Patent [19]

Ekstrom

[11] Patent Number: 5,086,749

[45] Date of Patent: Feb. 11, 1992

[54] ARROW GUN

[76] Inventor: Glen Ekstrom, 167 Cherry St., Ste. 286, Milford, Conn. 06460

[21] Appl. No.: 438,686

[22] Filed: Nov. 17, 1989

Related U.S. Application Data

[63] Continuation-in-part of Ser. No. 194,847, May 17, 1988, Pat. No. 4,890,597.

[51] Int. Cl.[5] ..... F41B 11/06; F41B 11/08; F41B 11/10; A01K 81/06

[52] U.S. Cl. ..... 124/74; 124/56; 124/71; 124/73; 43/6

[58] Field of Search ..... 124/56, 57, 70, 71, 124/73, 74; 43/6

[56] References Cited

U.S. PATENT DOCUMENTS

| | | | |
|---|---|---|---|
| 2,504,525 | 4/1950 | Holderness | 124/74 X |
| 2,642,056 | 6/1953 | Harris | 124/73 |
| 2,660,993 | 12/1953 | Blakeslee | 124/71 |
| 2,703,944 | 3/1955 | Molyneux | 124/73 X |
| 2,723,656 | 11/1955 | Andina | 124/57 |
| 2,833,266 | 5/1958 | Mares | 124/74 |
| 2,839,862 | 6/1958 | Hanshaw | 124/73 X |
| 2,900,972 | 8/1959 | Marsh et al. | 124/63 |
| 2,957,468 | 10/1960 | Enfield | 124/57 |
| 2,964,031 | 12/1960 | Dotson | 124/71 X |
| 3,102,525 | 9/1963 | Englis | 124/74 X |
| 3,142,293 | 7/1964 | Harter | 124/71 X |
| 3,735,747 | 5/1973 | Barjavel | 124/74 |
| 3,780,720 | 12/1973 | Alderson | 124/74 |
| 4,110,929 | 9/1978 | Weigand | 124/71 X |
| 4,890,597 | 1/1990 | Ekstrom | 124/74 |

*Primary Examiner*—Peter M. Cuomo
*Assistant Examiner*—John Ricci
*Attorney, Agent, or Firm*—Dilworth & Barrese

[57] ABSTRACT

An arrow gun and method for propelling arrows or harpoons in which the gun includes a compressed gas source such as compressed air or $CO_2$, a handle and trigger arrangement, and a high pressure air passageway system for linking the barrel to the gas source to propel or discharge the arrow. The arrow or harpoon is hollow and is slid over the barrel of the gun so that the barrel guides the arrow upon firing. The air passageway system is responsive to the actuation of the trigger such that the gun when loaded is not subject to pressure build-up and thus avoids accidental discharge hazards. Arrows with or without fletching may be used and are held in place when loaded without latching or locking. Arrows without fletching are held in the loaded position by a gripping means arranged in the vicinity of the point where the barrel connects to the gun, while arrows with fletching are engaged in a shroud cover which surrounds the barrel at the gun handle end.

13 Claims, 8 Drawing Sheets

ARROW GUN

CROSS-REFERENCE TO RELATED PATENT APPLICATIONS

This application is a continuation-in-part of copending application Ser. No. 194,847, filed May 17, 1988, U.S. Pat. No. 4,890,597.

BACKGROUND OF THE INVENTION

1. Field of the Invention

The present invention relates to arrow and harpoon guns, and more particularly, to guns which propel a hollow arrow or harpoon using, for example, a compressed gas source such as compressed air or $CO_2$ to propel the arrow.

Harpoon or arrow guns using an energy source such as compressed gas are well known in the art, as are those propelling arrows by ballistic means. These devices generally latch an arrow or harpoon into the barrel of the gun and energize the gun under high pressure prior to firing the arrow. The known compressed gas sources vary, and may include portable air bottles, $CO_2$ cartridges, scuba tanks, and the like. These guns are primarily for underwater use such as for spearing fish, but may be for use in other activities such as hunting.

2. Discussion of the Prior Art

In the prior art, various types of guns are disclosed, along with different types of arrows or harpoons, and several types of compressed air sources. These various devices, however, are subject to several disadvantages which, in many cases, inconvenience the user, and in some cases, require careful and specialized handling of the gun, since the gun when loaded is in a highly volatile condition where the possibility of accidental discharge is a hazard.

Mares, U.S. Pat. No. 2,833,266, discloses a spearfishing gun provided with a hollow-type spear which slides over an inner barrel of the gun and under a short outer barrel located near the handle. A compressible stopper is provided inside the spear tip to seal the open end of the inner barrel so that as the spear is latched, or locked, into the gun, the gun may be energized without leaking. Latching occurs due to a notched area on the shaft of the spear engaging a clip in the gun handle. The gun is energized by an attached compressed air container. This type of gun presents a typical but serious hazard to the user, since the gun is under high pressure while it is loaded and accidental discharge of the spear may occur. Once the spear is in place, the gun is always under an energized condition, so that mishandling may be hazardous.

Englis, U.S. Pat. No. 3,102,525, discloses an underwater dart or spear gun where the dart is placed over a short barrel of the gun similar to Mares. A $CO_2$-cartridge is located in the tip of the hollow dart, so that pulling the trigger forces a pointed-tip rod to extend into the dart to puncture the $CO_2$-cartridge, thus propelling the dart. This gun is also hazardous and must be carefully handled, since there is necessarily a very short distance from the pointed tip rod to the $CO_2$-cartridge, resulting in the possibility of accidental discharge. Furthermore, upon puncture of the cartridge, pressure is allowed to build in the gun, and the arrow is released only after complete depression of the trigger. This device suffers the further disadvantage that the darts are re-usable only after disassembly and replacement of the $CO_2$-cartridge Enfield, U.S. Pat. No. 2,957,468, is similar to Englis and also discloses a hollow arrow which slides over the barrel of the gun, and which is provided with a $CO_2$-cartridge in the tip of the arrow. The arrow is latched, or locked, onto the barrel and a pointed-tip rod moves forward upon pulling the trigger to puncture the $CO_2$-cartridge to propel the arrow. This device, of course, suffers the same disadvantages of the Englis device.

Andina, U.S. Pat. No. 2,723,656, discloses a gun in which a hollow dart fits inside the barrel of the gun and latches in place. Pressure is built up in the barrel to pressurize the dart prior to firing. The pressure build-up, of course, imparts the same disadvantage to this gun as described above, in that the hazard of accidental discharge always exists.

The novel arrow gun pursuant to the present invention obviates the disadvantages of the prior art and provides a highly accurate and powerful gun which is also safe to handle whether loaded or unloaded. It relieves the danger associated with prior art guns which energize the gun after the arrow is loaded and prior to firing. Accordingly, accidental discharge and the associated risk of injury is minimized or eliminated in the present invention. The present invention also provides a novel means for holding the arrow in place on the barrel after loading so that latching or locking the arrow in place is eliminated. Accordingly, jamming of the firing mechanism is avoided, and the arrow may be disengaged if necessary without firing the gun simply by sliding the arrow off the barrel.

Several guns disclosed in the prior art attempt to avoid the problem of latching or locking the arrow into the barrel. However, these guns, such as the gun disclosed in Hanshaw, U.S. Pat. No. 2,839,862, use a solid arrow or harpoon which fits into the barrel and is provided with a stopper-like end which seals the barrel after the arrow is inserted so that pressure builds up behind the stopper of the arrow to eventually force the arrow out of the barrel upon firing. Hanshaw also provides a stopper-like seal at the open end of the barrel, so that a hazardous pressure build-up may exist in the event the seal is too tight or the arrow jams. However, if the seal is not tight enough upon firing, the pressure will not be great enough to effectively propel the arrow.

A further disadvantage associated with the guns such as Hanshaw is that, due to the tolerances necessary to effect the proper build-up of pressure, arrows or harpoons with fletching may not be used. The fletching, of course, provides for accuracy in the flight of the arrow after firing. While the use of arrows or darts with fletching is possible in some guns in which the arrow is placed over the barrel, such as disclosed in Englis above, the fletching must be manually aligned upon loading to straddle the sides of the gun to allow for latching the arrow onto the barrel. In addition, if an outer barrel is provided such as that disclosed in Mares, the fletching again becomes prohibitive to the use of the gun.

SUMMARY OF THE INVENTION

The present invention eliminates or substantially ameliorates the disadvantages encountered in the prior art through the provision of an arrow, gun which avoids pressure build-up in the barrel until actual intended discharge of the gun. The user of the gun is projected from injury due to the accidental discharge of the gun, since firing pressure is applied to the barrel only upon actuation of the trigger mechanism to propel the arrow. Furthermore, the construction of the gun provides for high accuracy during use, since the arrows used slide over the barrel and use the barrel as a guide upon firing. Accuracy is also enhanced by the provision for fletching on the arrow, which of course aids in the accuracy of the flight path of the arrow.

A lightweight, easy to assemble and disassemble gun is provided with a source of compressed gas, which may be in the form of an attached compressed air or $CO_2$ container. The source of compressed gas may, of course, be any system for supplying compressed gas, such as a compressed air or $CO_2$ cartridge, a tank mounted on a boat, a scuba tank for underwater use, or the like. The source of compressed gas is attached directly to the gun, and is responsive to actuation of the trigger. Prior to firing there is no pressure build-up in the barrel of the gun, and after discharge of the arrow, there is again no pressure in the barrel so safe reloading is possible.

The gun of the present invention consists of a handle and trigger assembly with an integral air passageway system for connection of the compressed gas source to the handle of the gun. The air passageway system leads from the compressed gas source to the barrel to feed the compressed gas to the barrel for discharging the arrow upon actuation of the trigger. The barrel may be detachable and is connected to the handle by a collar, which properly seals the barrel to prevent pressure loss during firing of the arrow. The collar is provided with a novel means for seating the arrow, which is loaded onto the barrel by sliding the arrow over the barrel. A tapered gap is provided on the inner diameter of the collar which creates a seating gap which acts to releasably secure the arrow. The arrow may be "unloaded" if necessary by simply sliding it off the barrel, since there is no latching or locking of the arrow as in the prior art.

This tapered gap may b<supplemented by the provision of a gripping means such as rings or gaskets which surround the barrel in the vicinity of collar means. Slight pressure is applied to the inner circumference of the arrow shaft by the gripping means to hold the arrow in place without the build-up of internal pressure. Alternately, the tapered gap may be eliminated in favor of the gripping means.

The arrow, as stated, slides over the barrel and has an inner diameter which is slightly larger than the outer diameter of the barrel. The arrow, having a length slightly longer than the barrel, is "centered" due to the close tolerances between the arrow and barrel and is, therefore, discharged upon firing with extreme accuracy, since the barrel guides the arrow as it is fired. The arrow is held in place by the seating gap created by the tapered diameter of the inner surface of the collar, which may be supplemented by gripping means, or may be replaced by the gripping means, where the gripping means are positioned on the barrel preferably in grooves on the barrel at an end near the handle. The arrow may or may no& be provided with fletching to further increase the accuracy of a shot.

In a further embodiment&, a shroud cover may be provided on the collar which extends a distance along the length of the barrel, such that for that length the shroud coaxially encloses the barrel. The shroud is provided with an inner diameter which is slightly less than the diameter formed by the fletching on the arrow. As the arrow is loaded onto the barrel, it is rotated slightly to bend or roll over the fletching, so that upon firing the fletching "uncoils" and causes the arrow to spin to increase accuracy. This allows for a so-called "free floating" barrel, since the barrel is automatically centered by the fletching within the shroud. The fletching within the shroud also holds the arrow in place, so that the seating gas on the collar and the gripping means become optional when the shroud and fletching are present.

In yet another embodiment of the present invention, the hollow arrow is slid inside the barrel, where the inner diameter of the barrel is slightly larger than the outer diameter of the arrow. In this manner, the friction between the barrel and arrow restricts radial movement of the arrow and limits the axial sliding of the arrow as well. Upon firing, the pressurized air propels the arrow from the tip of the arrow, rather than from the rear, as in the prior art. The barrel is long enough to guide the arrow to ensure accuracy of the shot, and the close tolerances between the inner diameter of the barrel and outer diameter of the arrow limits pressure loss so that maximum firing pressure is achieved. In addition, these close tolerances tend to create a vacuum effect as the arrow leaves the barrel, which pulls the gun forward so that the gun itself is effectively recoilness.

A novel feature of the arrow gun of the present invention lies in the manner in which the arrow is propelled from the gun. The gun in essence is a recoilless gun, such that the recoil usually associated with high powered guns is eliminated, and in fact is actually reversed. Due to the close tolerances in the construction of arrow shaft and the barrel of the gun, as the arrow is propelled off the barrel a vacuum effect is created, such that the force of the arrow leaving the barrel creates a pulling force which tends to draw the gun in the forward direction away from the user. The recoil effect is thus eliminated, and in effect, reversed.

As a result of the high degree of accuracy and increased range, it is possible to modify the arrow tip to accommodate various payloads which may be accurately delivered to a location. Accordingly, the tip of the arrow may be replaced with devices such as grippling hooks, lifeline ropes, flares or the like, and may in particular accommodate water activated bouyancy devices such as a "Seaid" device which inflates upon impact with water. "Seaid" is a registered Trademark of Survival Technologies Group. The highly accurate placement of the arrow allows for safe delivery in rescue operations.

Another novel use of this device results from the fact that the use of a compressed air source allows a user to fire the arrow in locations where there is an absense of oxygen. A preferred use of the arrow gun of the present invention is of course underwater; however, it is also contemplated that the gun be available for use in other oxygen-free environments such as outer space. Guns using ballistic means such as gun powder are useless in these locations unless an oxidizer is provided, since oxygen is required for the gun powder to ignite to fire the arrow. Rescue operations in outer space, such as at space stations or outside the space shuttle as impossible with the arrow gun disclosed herein, be it for rescue of an astronaut or for adjustments to a satellite or the like.

The entire gun itself may be handheld, in either pistol or rifle form, or it may le stand-mounted for use as a harpoon-type gun on a boat. In that case, a rope or tether system may be provided for retrival of the harpoon in the event of a miss or for landing a fish if one is speared or harpooned.

Accordingly, it is an object of the present invention to provide a powerful, highly accurate compressed gas powered gun which avoids the hazard of unintentional or accidental discharge.

It is a further object of the invention to provide an efficient and extremely quiet means of firing an arrow or harpoon by providing an arrow which fits over a barrel of a gun and is discharged by an immediate high pressure energization of the gun from a compressed gas source.

It is still a further object of the invention to provide a novel means of holding an arrow over the barrel of a compressed gas powered gun without latching or locking the arrow onto the gun by providing means for frictionally engaging the arrow.

It is yet another object of the invention to allow for the use of arrows with fletching in an arrow gun to seat and hold the arrow in place and to center the barrel to increase the accuracy of the gun upon firing.

A still further object of the invention is to provide an arrow gun with a free floating barrel, such that the barrel is automatically aligned and centered by the arrow as the arrow is loaded onto the barrel of the gun.

It is yet another object of the invention to provide an arrow gun which accurately delivers an arrow and payload attached to the arrow to a required location, where the payload includes devices such as grappling hooks, ropes, flares, floatation devices and the like.

It is a further object of the invention to provide a recoilless arrow gun in which the constructional tolerances between the arrow to be fired and the barrel of the gun leads to the creation of a vacuum effect upon firing to pull the gun in the direction of the arrow to effectively eliminate recoil.

BRIEF DESCRIPTION OF THE DRAWINGS

The following objects and other features of the invention will become more readily apparent and may be understood by referring to the following detailed description of an illustrative embodiment of the air powered arrow gun, taken in conjunction with the accompanying drawings, in which.

DETAILED DESCRIPTION OF THE PREFERRED EMBODIMENT

Figure 1:
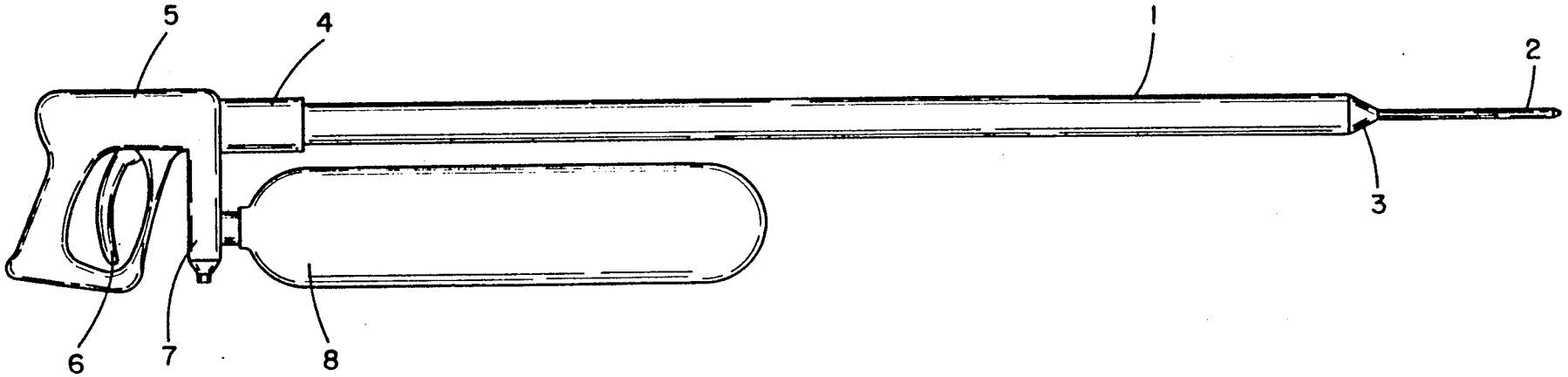
FIG. 1 illustrates a side elevation of a preferred embodiment of the arrow gun pursuant to the present invention.
Figure 2:
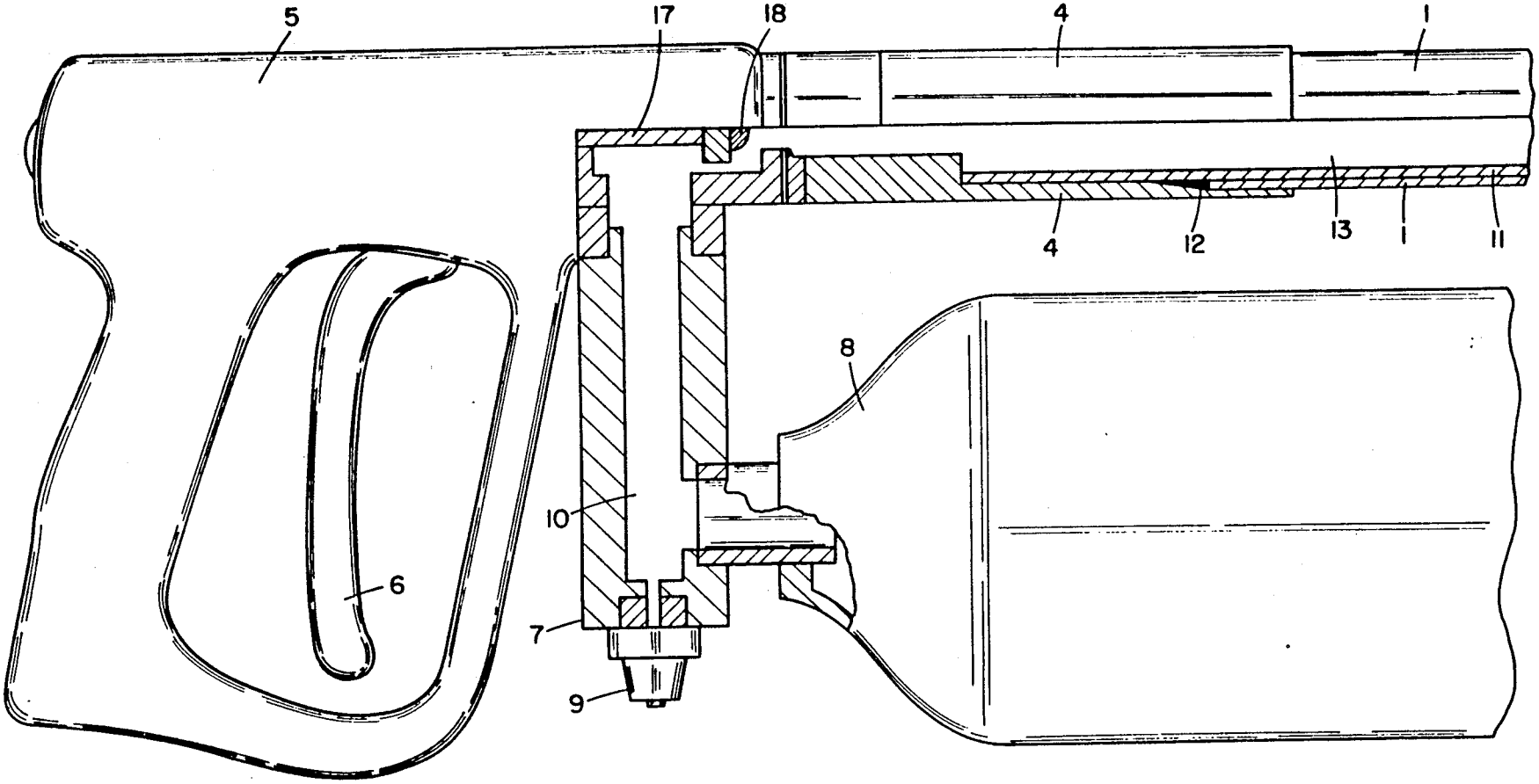
FIG. 2 illustrates an enlarged cut-away side view of the handle and air passageway system of the arrow gun of FIG. 1.

Referring now in specific detail to the drawings, in which identical reference numerals identify similar or identical elements throughout the several views, FIG. 1 shows a preferred embodiment of the arrow gun with an arrow loaded onto the barrel of the gun. The arrow 1 is slid over the barrel 11 as shown in FIG. 2 in frictional engagement, since the outer diameter of barrel 11 is slightly less than the inner diameter of arrow 1. Arrow 1 is hollow, and is provided with a sharpened tip position 2 which is secured to arrow 1 at an end cap 3. Alternatively, arrow 1 may taper into tip 2 such that tip 2 is part of and integral to arrow 1. Arrow 1 is made of rigid material, and is preferably constructed of lightweight, conventional materials such as aluminum, fiberglass and the like. However, in other embodiments such as described below, heavier, more rigid materials such as steel or stainless steel may be used.

The arrow gun of the present invention comprises essentially a handle 5 which is provided with a system for discharging arrow 1 which includes trigger 6 and compressed gas source 8. The barrel 11 is connected to handle 5 by means of a collar means 4 which secures the barrel 11 and seals it against leakage of pressure by conventional means such as O-rings or gaskets. The compressed gas source 8 as shown may be a compressed air or $CO_2$ container secured by threaded couplings to air passageway chamber 7, and again sealed by conventional means such as O-rings or gaskets and a spring-biased ball valve. Alternatively, the compressed gas source may be a remote tank, mounted for instance on a boat, or a tank such as a scuba tank, rr a tank carried by a user of the gun. In such a case, container 8 may be eliminated, and the remote compressed gas source may be connected by means of hoses (not shown) to quick-connect valve 9.

As seen in FIG. 2, chamber 7 is provided with air passageway channel 10 which cooperates with container 8, or alternatively valve 9, and links the compressed gas source with the barrel interior channel 13. Chamber 7 is constructed of a rigid material capable of withstanding the high pressures associated with the compressed gas sources contemplated by the invention, which may be up to 3000 p.s.i. Stop means 17 and seal means 18 are provided which seal off barrel channel 13 such that there is no pressure in channel 13 until actuation of trigger 6. Trigger 6 is preferably biased under tension whereby inadvertent actuation is avoided. The stop means 17 and seal means 18 which isolate the air passageway channel 10 from barrel channel 13 are responsive only to trigger 6 and are biased strongly towards the closed, or sealed position so that only intentional actuation of the trigger causes communication between channels 10 and 13 to deliver gas pressure to the barrel to discharge arrow 1. Upon actuation of the trigger, discharge of the arrow 1 is instantaneous, and there is no prior build-up of pressure to result in a hazardous condition. Upon completion of discharge, the stop means and seal means again isolate barrel channel 13 from air passageway channel 10 to allow for the safe reloading of another arrow 1.

Figure 3A:
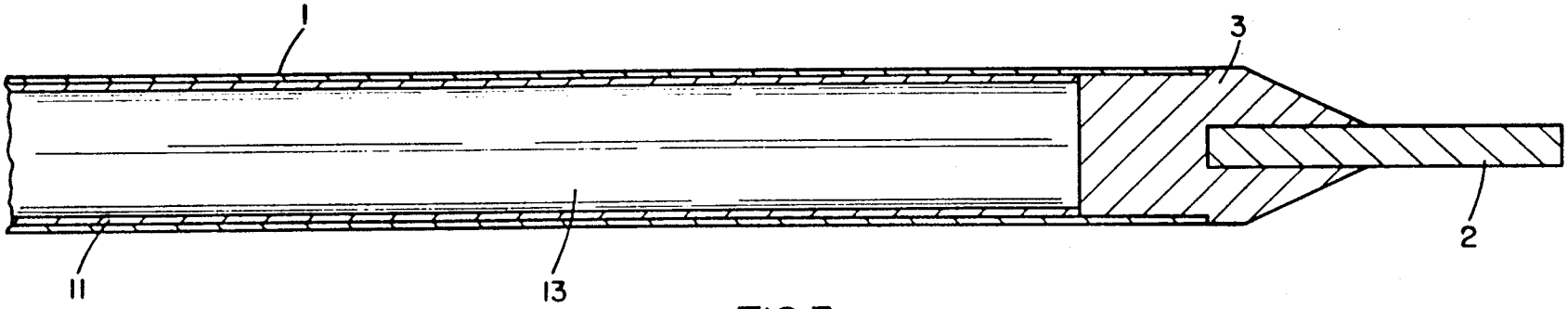
FIGS. 3*a* and 3*b* illustrate an enlarged cut-away side view of the barrel and collar assembly of the arrow gun of FIG. 1, with an arrow loaded onto the barrel.
Figure 3B:
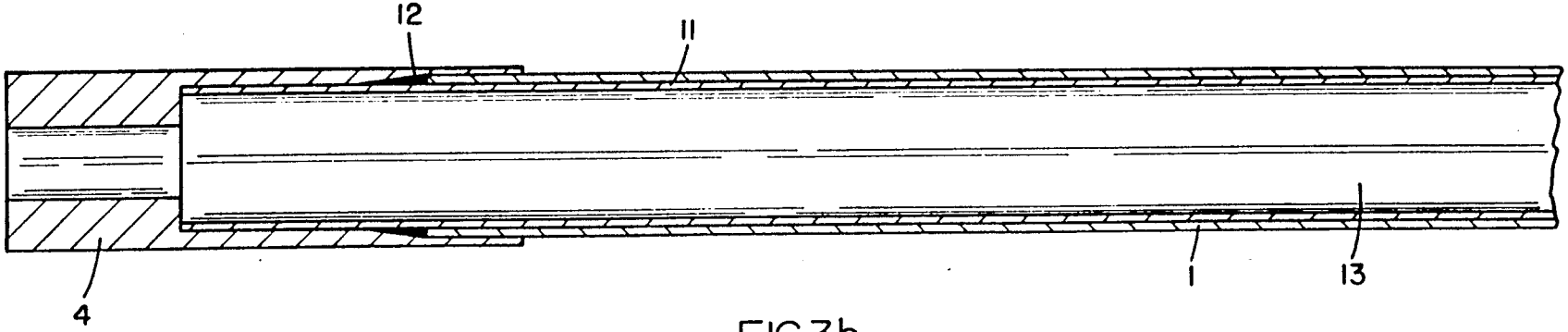

In use, the arrow 1 is slid over and down barrel 11, as seen in FIGS. 2, 3a and 3b. The tolerances between the diameters of the barrel 11 and the arrow 1 are precise, so that the arrow 1 slidingly engages barrel 11. The arrow 1 slides over the barrel 11 and inside collar 4, which has an inner diameter very close to the outer diameter of the barrel 11 at the handle end of collar 4. Conventional sealing means are provided, such as O-rings, frr sealing the connection of barrel 11 to collar 4 to prevent pressure leaks upon firing. The end of collar 4 remote from tandle 5 is provided with a tapering inner diameter such that the inner diameter is larger at the remote end than at the handle end. The tapered area forms a seating gap 12 which seats and holds the arrow 1 and restricts its movement so that it does not inadvertently slide off barrel 11. Preferably, barrel 11 terminates at end cap 3 as shown in FIG. 3a.

Figure 6:
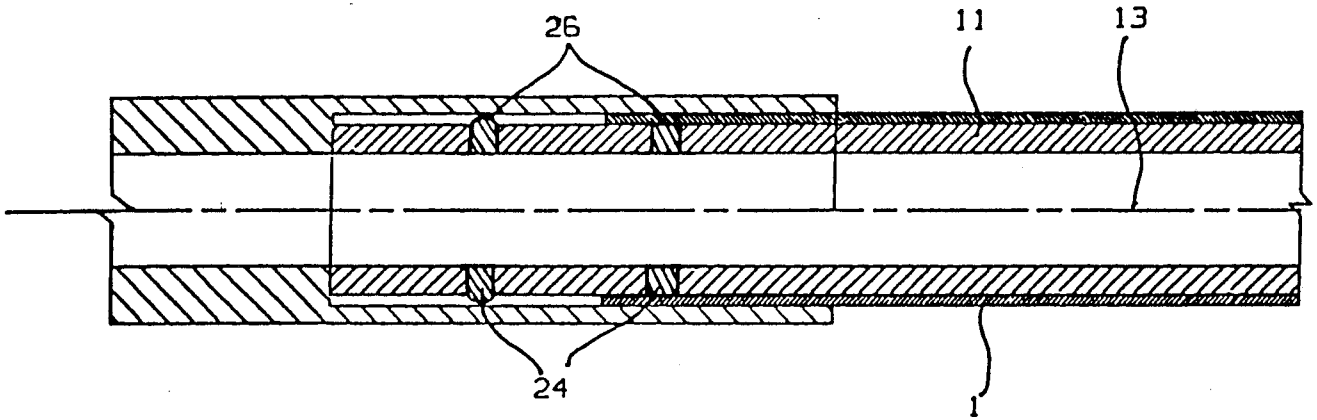
FIG. 6 illustrates ar enlarged cut-away side view similar to FIG. 3*b* showing an alternate means for securing the arrow into the barrel of the gun.

Alternately, as shown in FIG. 6, O-ring gaskets 24 may be provided to frictionally engage the arrow. As the arrow slides onto the barrel, the O-rings 24 are compressed to grip the arrow and prevent it; sliding back off the barrel, in much the same manner as the tapered seating gap 12. The O-rings are preferably positioned in grooves 26 located on the barrel, but may also be positioned on the inner circumference of the arrow (not shown).

Figure 7:
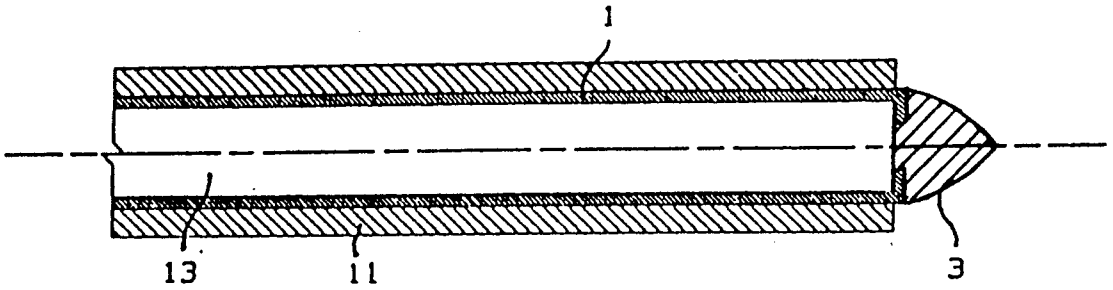
FIG. 7 illustrates ar enlarged cut away side view of an alternate embodiment of the present invention showing a hollow arrow mounted within the barrel of the gun.

In a further embodiment of the invention, as shown in FIG. 7, the hollow arrow 1 may be slid within an elongated barrel 11 of the gun, so that the shaft of the arrow frictionally contacts the inner surface of the barrel 11. The arrow may be frictionally engaged at its open end of the manner described herein. The constructional tolerances between the outer diameter of the arrow and the inner diameter of the barrel are such that contact between the arrow and barrel restricts radial movement of the arrow and prevents pressure loss during filing. When the arrow is fired, the closed cap 3 of the arrow allows the arrow to be propelled from the front to increase its accuracy as the barrel guides the arrow out. The propelling force at the front of the arrow, in conjunction with the close tolerances between the arrow and barrel, creates a vacuum effect which tends to draw the gun forward during firing so that gun is effectively recoilless.

FIGS. 4a–4d disclose a second embodiment of the present invention, which allows for the use of arrows or harpoons provided with fletching at the end of the arrow opposite the tip 2. Arrow 1a is similar to arrow 1 except for the fletching 16 which is conventional and is constructed of a flexible material. Collar 4 is supplemented with a shroud 14 which is connected to collar 4 at mount 15. Alternatively, collar 4 may be eliminated, such that shroud 14 is integral with a collar of its own for connection to handle 5.

Figure 4C:
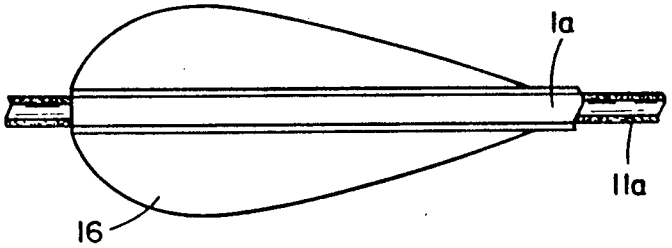
FIG. 4*c* illustrates the arrow of FIG. 4*a* prior to insertion into the shroud cover.
Figure 4D:
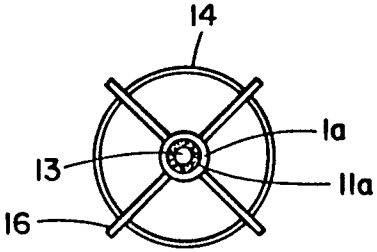
FIG. 4*d* shows the arrow of FIG. 4*c* along lines *d—d* of FIG. 4*c*.
Figure 4A:
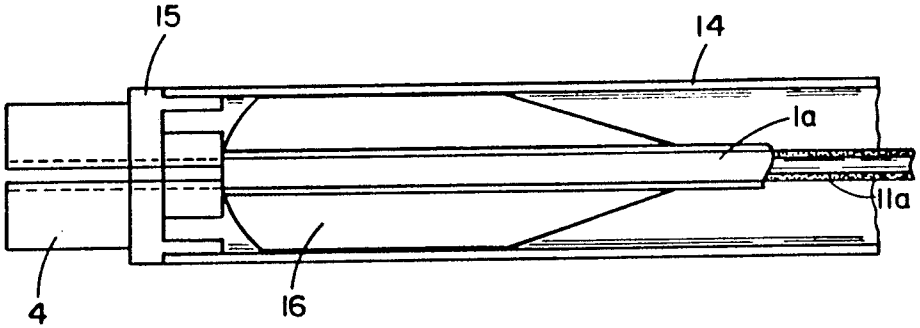
FIG. 4*a* illustrates an enlarged cut-away side view of the shroud cover of a second embodiment of the present invention for use with arrows having fletching.
Figure 4B:
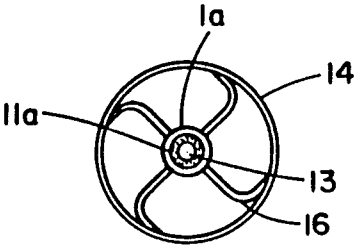
FIG. 4*b* shows the arrow of FIG. 4*a* along lines *b—b* of FIG. 4*a*.

In use, arrow la is slid over barrel 11a to load the gun as shown in FIG. 4c. The diameter formed by fletching 16 is greater than the inner diameter of shroud 14 as shown in FIG. 4d. As the fletching 16 reaches the shroud 14, the arrow la is rotated slightly such that the fletching 16 rolls over to form a helicoil as shown in FIG. 4b. The fletching 16 supports and holds the arrow to center the arrow 1a for accuracy. Accordingly, the barrel 11a may be a "free-floating" barrel, such that its alignment inside shroud 14 need not be purely coaxial before loading, since fletching 16 will perfectly center the arrow 1a, and hence the barrel 11a, upon loading. Upon firing the helicoil formed by the fletching 16 causes the arrow 1a to spin at a faster rate to create a type of rifling which ensures a more accurate shot.

Figure 5A:
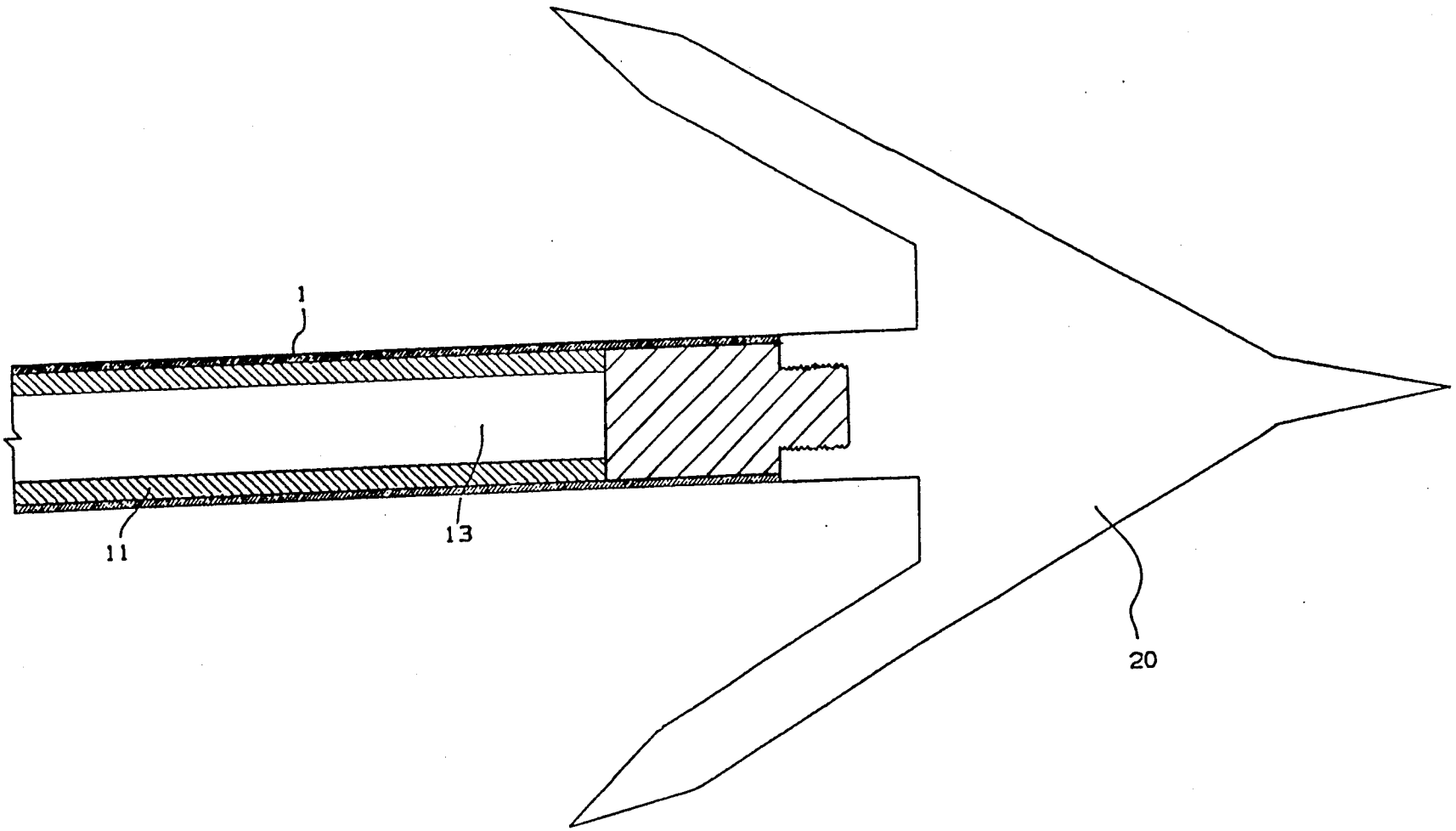
FIG. 5*a* illustrates the arrow having a payload affixed to its end, such as grappling hooks.
Figure 5B:
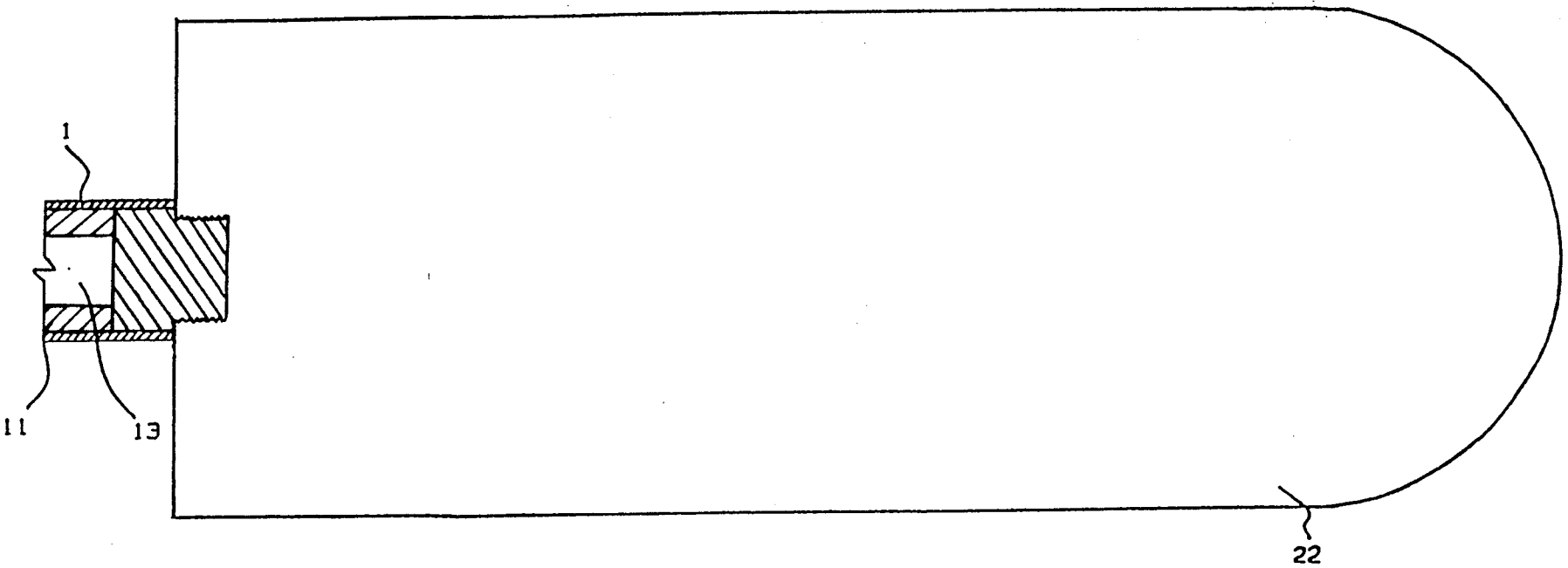
FIG. 5*b* illustrates the arrow having a cannister-type payload containing a rescue device.

As shown in FIGS. 5a and 5b, the arrow tip 2 may be replaced with various payload: for accurate delivery to a location, such as during rescue operations. Various types of payloads may be delivered, such as grappling hooks 20, or rescue device cannisters 22, such, as a "Seaid" device. "Seaid" is a registered trademark of Survival Technologies Group. These devices may be secured to the arrow in any known manner, but preferably, the arrow end is provided with screw threads which engage a threaded portion of the payload device.

The arrow gun of the present invention is a highly powerful and accurate gun for firing arrows or harpoons under compressed gas pressure such as compressed air or $CO_2$. The gun is in essence a recoilless gun, which is an important feature due to the high pressures under which the arrows are fired. Variations on the embodiments described above are contemplated and may include innovations such as tethering a line to the arrow for retrieval purposes, and also mounting the gun on a stand for use on a boat or the like.

While the invention has been particularly shown and described with reference to the preferred embodiments, it will be understood by those skilled in the art that various modifications and changes in form and detail may be made therein without departing from the scope and spirit of the invention. Accordingly, modifications such as those suggested above, but not limited thereto, are to be considered within the scope of the invention.

What is claimed is:

1. An arrow gun for propelling an arrow, harpoon or the like, comprising a handle including a trigger;

an elongated hollow barrel extending at a first end from said handle having an opening at a second end remote from said handle;

collar means for securing said barrel to said handle, said collar means being fixedly secured at a first end to said handle and circumferentially engaged about said barrel;

means positioned on said first end of said barrel for frictionally engaging said arrow about said barrel;

a compressed gas source; and connection means including an air passageway for linking said compressed gas source to said barrel for releasing said compressed gas under pressure from said barrel into said hollow arrow at said second end of said barrel remote from said handle to propel said arrow;

whereby said arrow is hollow and sealed at one end forming a tip, said arrow having an inner diameter slightly larger than an outer diameter of said barrel such that said arrow maintains contact with said barrel along its length and is frictionally disposed over said barrel prior to being propelled, said arrow being secured over said barrel at said first end by said frictional engagement means of said barrel, said arrow being fired under pressure upon actuation of said trigger.

2. An arrow gun according to claim 1, wherein said frictional engagement means comprises circumferential gaskets or O-rings disposed in grooves in said first end of said barrel.

3. An arrow gun according to claim 1, wherein said frictional engagement means comprises circumferential gaskets or O-rings disposed in grooves on an inner circumferential surface of said hollow arrow.

4. An arrow gun according to claim 1, wherein said collar means is provided with a plurality of seal means circumferentially positioned about said inner diameter of said collar means which are compressible to frictionally engage said arrow.

5. An arrow gun according to claim 1, wherein said arrow has an inner diameter slightly larger than said barrel outer diameter, said arrow further having an outer diameter slightly less than said collar means inner diameter.

6. A method of propelling a payload attached to an arrow head of a hollow arrow, said payload and arrow being fired from a gun, comprising attaching said payload to said arrow head;

sliding said arrow over an elongated discharge barrel of said gun, said arrow having an inner diameter slightly larger than an outer diameter of said barrel, said gun including a handle and trigger assembly, said barrel being hollow and connected to said handle at one end of said barrel and having a discharge opening at a second end;

engaging by means of friction an end of said arrow opposite said arrow head at said handle end of said barrel to restrict its movement by sliding said arrow over a series of gripping means positioned in grooves in said barrel adjacent said handle; and activating a compressed gas source to energize said barrel of said gun to discharge gas from said second end of said hollow barrel remote from said handle;

whereby said arrow maintains frictional contact with said barrel along its length and is instantaneously propelled from said gun upon activation of said gas source by sliding off said barrel under high pressure.

7. A method according to claim 6, wherein said payload comprises a cannister containing a life saving device.

8. A method according to claim 6, wherein said payload comprises grappling hooks.

9. A method according to claim 6, wherein said payload comprises a rescue line.

10. A method according to claim 6, wherein said gripping means comprises gaskets.

11. A method according to claim 6, wherein said gripping means are positioned on the inner circumferential surface of said hollow arrow.

12. An arrow gun for propelling an arrow, harpoon or the like, comprising a handle including a trigger;

an elongated hollow barrel extending at a first end from said handle having an opening at a second end remote from said handle;

collar means for securing said barrel to said handle, said collar means being fixedly secured at a first end to said handle and circumferentially engaged about said barrel;

a compressed gas source; and connection means including an air passageway for linking said compressed gas source to said barrel for releasing said compressed gas under pressure from said barrel into said hollow arrow at said second end of said barrel remote from said handle to propel said arrow;

whereby said arrow is hollow and sealed at one end forming a tip, said arrow having an inner diameter slightly larger than an outer diameter of said barrel such that said arrow maintains contact with said barrel along its length and is frictionally disposed over said barrel prior to being propelled, said arrow being secured over said barrel at said first end by friction with said barrel, said arrow being fired under pressure upon actuation of said trigger.

13. An arrow gun according to claim 1, wherein said compressed gas source propels said arrow under pressures up to 3000 p.s.i.

* * * * *

UNITED STATES PATENT AND TRADEMARK OFFICE

CERTIFICATE OF CORRECTION

PATENT NO. : 5,086,749

DATED : February 11, 1992

INVENTOR(S) : Glen Ekstrom

It is certified that error appears in the above-identified patent and that said Letters Patent is hereby corrected as shown below:

| | |
|---|---|
| Column 2, line 65 | "arrow, gun" should be --arrow gun-- |
| Column 3, line 39 | "b<" should be --be-- |
| Column 3, line 62 | "embodiment&" should be --embodiment-- |
| Column 4, line 7 | "gas" should be --gap-- |
| Column 4, line 26 | "recoilness" should be --recoilless-- |
| Column 4, line 43 | "grippling" should be --grappling-- |
| Column 4, line 62 | "impossible" should be --possible-- |
| Column 4, line 66 | "le" should be --be-- |
| Column 6, line 4 | "ar" should be --an-- |
| Column 6, line 41 | "rr" should be --or-- |
| Column 7, line 11 | "frr" should be --for-- |
| Column 7, line 13 | "tandle" should be --handle-- |
| Column 7, line 23 | "it;" should be--its-- |
| Column 7, line 38 | "filing" should be --firing-- |

UNITED STATES PATENT AND TRADEMARK OFFICE

CERTIFICATE OF CORRECTION

PATENT NO. : 5,086,749

DATED : February 11, 1992

INVENTOR(S) : Glen Ekstrom

It is certified that error appears in the above-identified patent and that said Letters Patent is hereby corrected as shown below:

Column 8, line 5 "payload:" should be --payloads--

Signed and Sealed this

Twenty-seventh Day of April, 1993

*Attest:*

MICHAEL K. KIRK

*Attesting Officer*

*Acting Commissioner of Patents and Trademarks*